United States Patent [19]

Gach

[11] 4,310,105

[45] * Jan. 12, 1982

[54] CHILD-RESISTANT DISPENSING CLOSURE

[75] Inventor: Peter P. Gach, Evansville, Ind.

[73] Assignee: Sunbeam Plastics Corporation, Evansville, Ind.

[ * ] Notice: The portion of the term of this patent subsequent to Dec. 2, 1997, has been disclaimed.

[21] Appl. No.: 139,840

[22] Filed: Apr. 24, 1980

[51] Int. Cl.[3] ..... B65D 47/08

[52] U.S. Cl. ..... 222/153; 222/543; 222/556

[58] Field of Search ..... 222/153, 182, 402.11, 222/402.13, 562, 543, 556, 561, 517; 215/201, 224; 220/331, 339

[56] References Cited

U.S. PATENT DOCUMENTS

| | | | |
|---|---|---|---|
| 2,971,680 | 2/1961 | Wilson et al. | 222/561 |
| 4,010,875 | 3/1977 | Babiol | 222/517 |
| 4,127,221 | 11/1978 | Vere | 222/153 |
| 4,236,653 | 12/1980 | Gach | 222/153 |

*Primary Examiner*—H. Grant Skaggs

*Attorney, Agent, or Firm*—Fisher, Gerhardt, Crampton & Groh

[57] ABSTRACT

A child-resistant dispensing closure consisting of a one-piece molding of resilient material that comprises an inverted cup-shaped cap having a central dispensing opening and a saucer shaped lid that is integrally hinged to the cap at one edge thereof for movement to and from an inverted, closing position closely over-lying the cap. The lid has an element which closes the dispensing opening and engages in telescoping relationship therewith. The cap and lid have overlapping catch means for retaining the lid in closing position. In the closing position, no part of the lid extends beyond the margin of the cap so there is nothing which a small child can grasp in order to swing the lid to gain access to the content material. The hinge is double acting and provides not only for angular movement to and from the closing position but also for lateral movement of the lid relative to the cap against the resilience of the engaged element and opening for disengaging the catch means. In a preferred embodiment, the dispensing opening is in the upper end of a nozzle which is an integral part of the cap and the closing element is on the underside of the lid, so that it engages the upper end of the nozzle and closes the nozzle opening.

6 Claims, 7 Drawing Figures

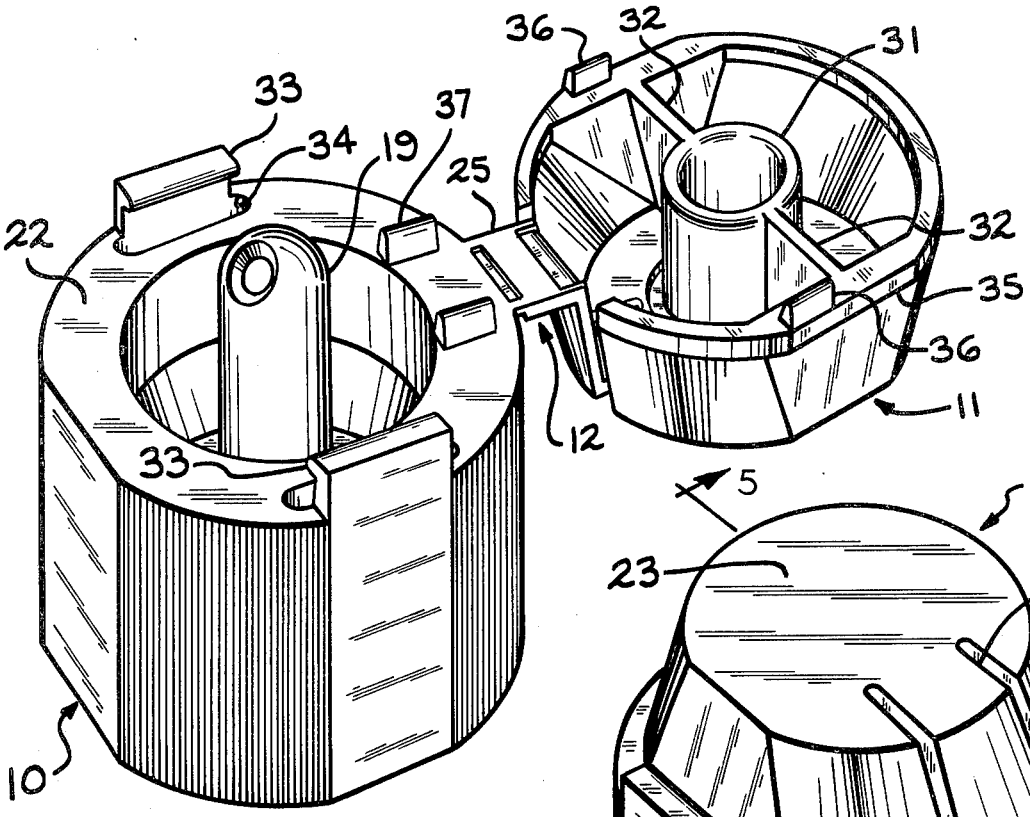
FIG. 1
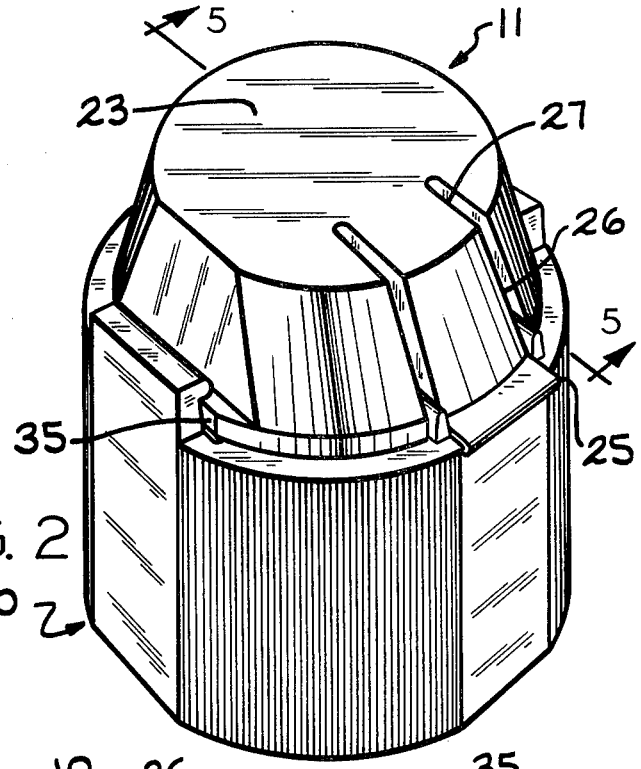
FIG. 2
FIG. 3
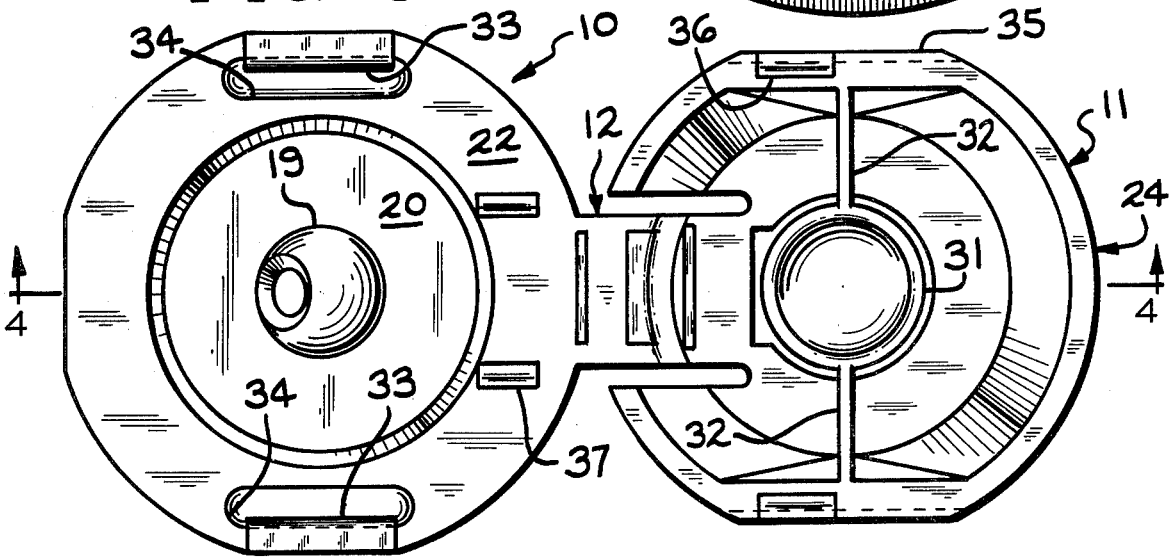

FIG. 4
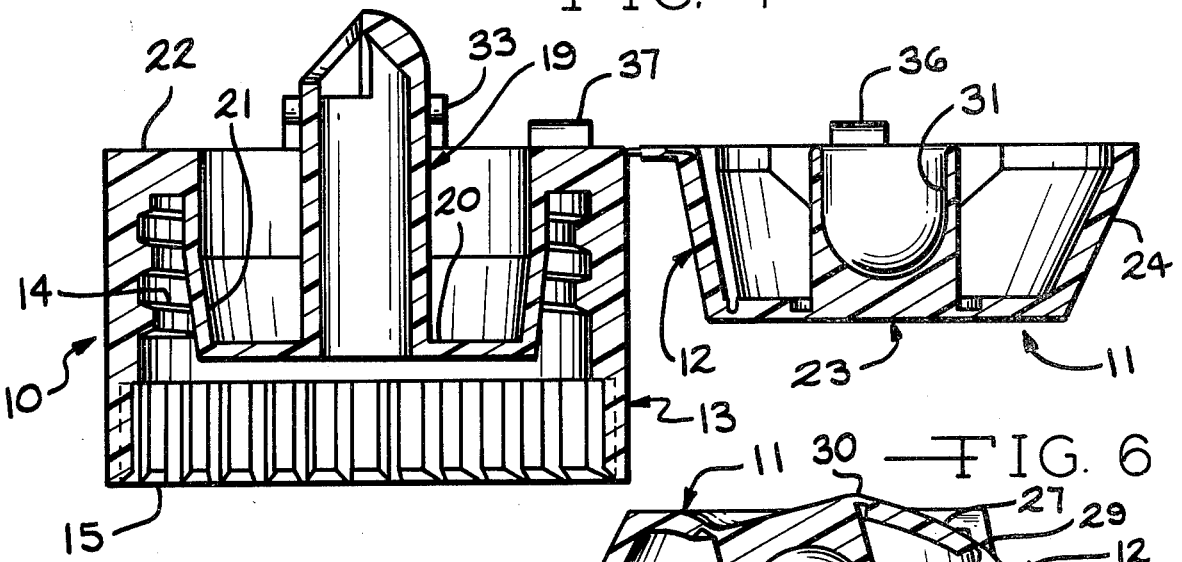
FIG. 6
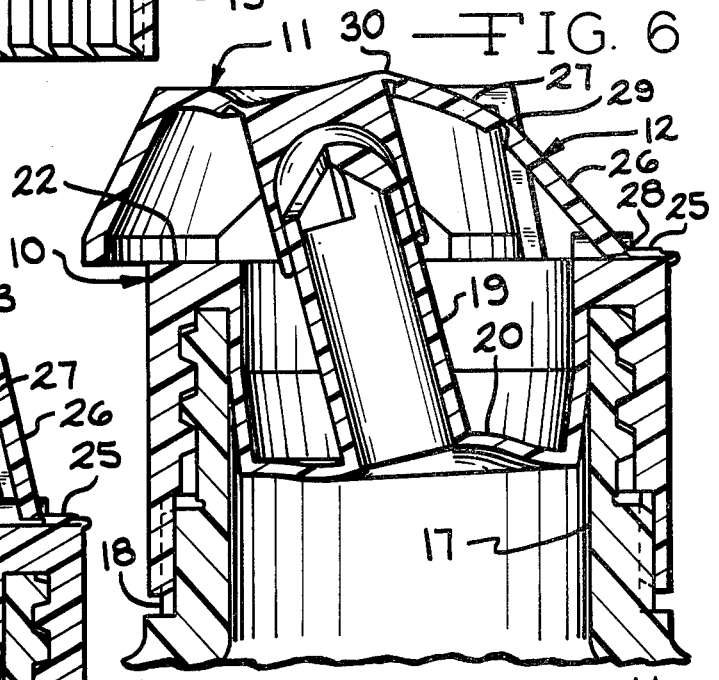
FIG. 5
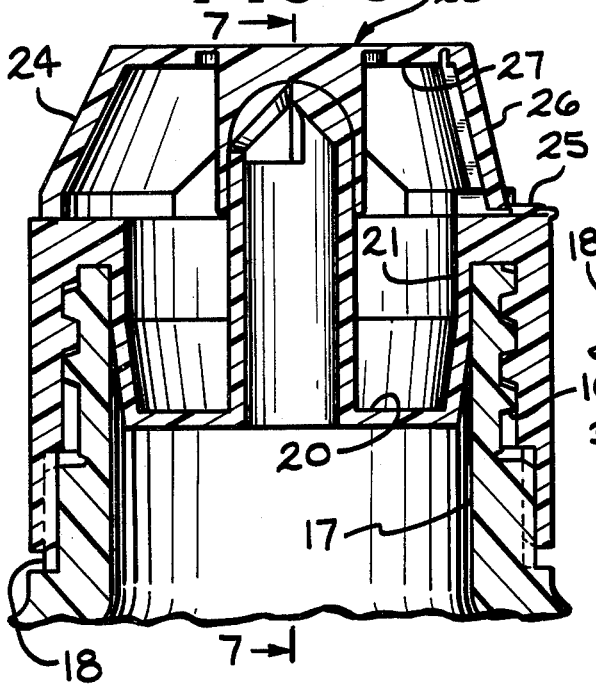
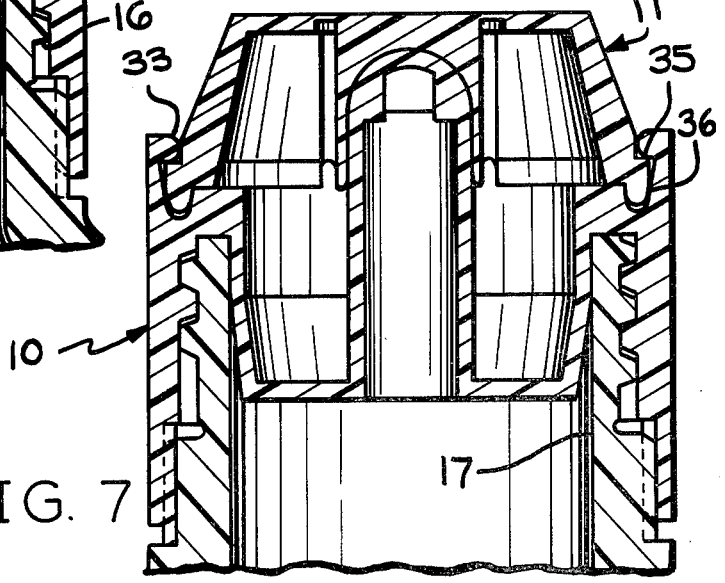
FIG. 7

CHILD-RESISTANT DISPENSING CLOSURE

BACKGROUND OF THE INVENTION

This application discloses an improved modification of the closure disclosed and claimed in my copending application Ser. No. 61,832 filed July 30, 1979, now U.S. Pat. No. 4,236,653 granted Dec. 2, 1980, but it is not a continuing application relative thereto because the specific embodiment of the present application was not disclosed in the earlier application.

Because of the fact that many substances found in an average home are extremely dangerous and often life threatening, particularly if consumed by a child of tender years, much emphasis has been placed on packaging many such substances in containers provided with child-resistant caps. For example, many drugs, both prescription and over-the-counter, are so packaged, as are some dangerous liquid and particulate substances such as anti-freeze for automobiles, drain cleaners, furniture polishes, etc.

The most successful of the child-resistant closures usually have had two features in common. First, in order to remove or open the closure, it has been necessary that two separate and dissimilar movements or actions take place. It has been found that a child of tender years, say six or less, usually does not readily comprehend how these two dissimilar actions must be performed, although an older child or an adult can do so by reading the instructions which usually are printed or molded on the closures. Secondly, some of the most successful child-resistant closures have also had the property of clearly indicating to an observing adult whether or not the closure is in child-resistant status or merely has been returned to its container without being restored to protective condition.

Unfortunately, many other substances which commonly are found in domestic situations have not yet been provided with satisfactory child-resistant closures. For examples, toilet bowl cleaning liquids, dishwashing liquids, and others, which usually are packaged in containers having dispensing openings, still appear in the market place with closures which an average small child can readily open.

Many prior art child-resistant caps can be replaced upon their containers in what seems to be closed position without actually being re-established in child-resistant status. As a result, if the user is inattentive or a little bit careless, it may seem that the closure is safe although it really is not.

It is, therefore, the principal object of the invention to provide a child-resistant dispensing closure particularly designed to be utilized on containers of liquid materials which are dispensed in small quantities.

It is a second and equally important object of the instant invention to provide a child-resistant dispensing closure which positively indicates whether or not it is in protective status and which automatically returns to child-resistant status every time it is closed.

Yet another object of the instant invention is to provide a child-resistant dispensing closure which requires that two completely dissimilar actions be simultaneously performed in order to open the closure.

And another object of the instant invention is to provide a child-resistant dispensing closure which has no readily graspable protruding parts which a small child can grasp, even with its teeth.

And yet another object of the instant invention is to provide a child-resistant dispensing closure having the foregoing features which readily can be manufactured as a single, unitary piece of resilient, resinous material such as polypropylene or the like, thus enabling high-speed production in multi-cavity molds in order to minimize cost.

BRIEF DESCRIPTION OF THE DRAWINGS

FIG. 1 is a view in perspective of a closure embodying the invention shown in open position;

FIG. 2 is a view in perspective showing the closure of FIG. 1 in closing position, the view being rotated approximately 90° in a clock-wise direction from the position of the closure as illustrated in FIG. 1;

FIG. 3 is a top plan view of the closure shown in FIG. 1;

FIG. 4 is a vertical, sectional view taken along the line 4—4 of FIG. 3;

FIG. 5 is a diametrically extending, vertical sectional view taken generally from the position indicated by the line 5—5 of FIG. 2 and showing a closure embodying the invention in position on the neck of a container which is fragmentarily illustrated, the closure being shown in closing position;

FIG. 6 is a view similar to FIG. 5 and showing a part of the closure in a first position to which it must be moved in order to gain access to the content material; and FIG. 7 is a view similar to FIGS. 5 and 6 taken along the line 7—7 of FIG. 5.

DESCRIPTION OF PREFERRED EMBODIMENT

An improved child-resistant dispensing closure embodying the instant invention consists of an inverted cup-shaped cap 10 and a generally saucer-shaped lid 11 which is integrally connected to the cap 10 by an integral hinge 12.

The cap 10 has an annual skirt 13 (see FIG. 4), the inner side of the skirt 13 being provided with threads 14 and ratchet teeth 15. The threads 14 are adapted to mate with threads 16 on the exterior of a container neck 17 fragmentarily shown in FIGS. 5–7, inclusive, and the ratchet teeth 15 similarly cooperate with ratchet teeth 18 formed on the exterior of the neck 17 and also shown in FIGS. 5–7, inclusive.

The cooperating threads 14 and 16 retain the closure on the container and the cooperating ratchet teeth 15 and 18 prevent the closure from being removed from the container once it has been threaded onto the container neck 17 thus precluding its removal by a child.

Cap 10 has an axially extending dispensing nozzle 19 which is connected at its lower end by an annular web 20 to the lower end of an inner wall 21. The upper end of the wall 21 is connected by an annular cap rim 22 to the upper end of the threaded skirt 13. The skirt 13 and wall 21 provide a tubular space between the outer side of the inner wall 21 and the inner side of the skirt 13 for the reception of the end of the container neck 17 as also is shown in FIGS. 5–7, inclusive.

The lid 11 has a flat, generally circular top 23 and a generally frusto-conical side wall 24. The lid 11 is integrally connected to the cap 10 by the generally radially extending hinge 12 which, in the embodiment illustrated, consists of several portions. A narrow web 25 is connected at one edge to the cap 10 and at its opposite edge to a longer hinge web 26. The web 26, in turn, is connected to a radially extending web 27. As best can be seen in FIG. 2, when the lid 11 is in closing position on top of the cap 10, the hinge webs 26 and 27 are recessed into a slot in the side wall 24 and top 23 of the lid 11, respectively, and thus appear to be portions thereof.

The hinge 12 has thinner sections 28, 29 and 30 where the hinge webs 25, 26 and 27 are connected to each other thus providing flex lines. By applying lateral pressure to the hinge web 26, as shown in FIG. 6, the entire lid 11 may be moved from closing position, as shown in FIG. 5, to the position shown in FIG. 6 which causes the edge of the lid 11 to protrude laterally beyond the margin of the cap rim 22. This enables a person to grasp the then protruding edge of lid 11 in order to swing it upwardly and around in a clock-wise direction from the position illustrated in FIG. 5 to the position illustrated in FIG. 4.

The closure lid 11 has a nozzle cap 31 on its underside, the cap 31 being of such size and depth as to telescope over the end of the dispensing nozzle 19 when the lid 11 is in closing position as illustrated in FIGS. 2, 5 and 7.

The thinner section 30 of the lid top 23 surrounds the nozzle cap. Because the entire closure preferably is molded from a somewhat stiffly resilient material, such as polypropylene resin, the section 30 and the lower annular web 20 bias the lid 11 against movement from the position of FIG. 5 to the position of FIG. 6. The nozzle cap 31 also may be rigidified as desired and its resilience may be increased by extending reinforcing webs 32 diametrically from opposite sides of the nozzle 31 to the inner sides of the lid side wall 24.

The cap 10 and lid 11 have cooperating means which retain the lid 11 in closing position as shown in FIG. 5 and guide it during its movement to the position illustrated in FIG. 6. These means consist of over-hanging lips 33 erected on opposite sides of the cap rim 22 at the outer edges of generally tangential recesses 34 molded into the rim 22. Flat lips 35 are formed at the corresponding sides of the lid 11 which are adapted to slide beneath the lips 33 of the cap 10 and to remain, at least partially, interengaged therewith even when the lid is moved to the position shown in FIG. 6. The limit of such lateral movement is determined by tabs 36 which are formed on the edges of the lid 11 so that they drop into the recesses 34 (see also FIG. 7) when the lid 11 is in the positions of both FIGS. 5 and 6 thus to limit the horizontal translatory movement of the lid 11 relative to the cap 10 in both directions.

A pair of hinge guides 37 is erected on the cap rim 22 to guide the web of the hinge 12 as the lid 11 is swung from the open position of FIG. 1 to the closed position of FIG. 2 and moved laterally to the preliminary position of FIG. 6.

Having described my invention, I claim:

1. A child-resistant dispensing closure for a container having a threaded neck, said closure consisting of (a) a cup-shaped body having
  (1) an annular skirt with mating threads on its inner surface,
  (2) a flat, inwardly extending annular rim at the upper edge of said threaded skirt,
  (3) a circular wall extending downwardly from the inner edge of said rim, said wall being co-axial with said skirt,
  (4) an inwardly directed, annular web at the bottom edge of said wall, and
  (5) an upwardly extending, tubular dispensing nozzle integral with and connected by said web to the bottom edge of said wall, and having a dispensing orifice at its upper end, (b) a generally saucer-shaped lid having
  (1) a flat top,
  (2) a generally frusto-conical side wall,
  (3) a nozzle cap on the under side of said top that is adapted to close the orifice in said nozzle when said lid is in closing position closely overlying said body, said lid being of such size and shape that no part of said lid over-hangs said rim in such closing position, (c) a flexible hinge web connecting said lid to said body at adjacent edges thereof, said web having a length sufficient to provide for (1) angular movement of said lid relative to said body from such closing position with said nozzle cap closing said dispensing orifice and (2) lateral translatory movement relative to said body from such closing position a distance sufficient that the lower edge of said lid over-hangs the edge of said body rim, and (d) co-operating child-resistant catch means on said lid and on said body consisting of horizontal lips on said body rim and on said lid side wall which are engaged when said lid is in such closing position overlying said body and which are disengageable by grasping the over-hanging edge of said lid after moving said lid from such closing position laterally relative to said body.

2. A child-resistant dispensing closure according to claim 1 and inter-engaging means on said closure and the neck of the container which resist rotation of said closure relative to said container.

3. A child-resistant dispensing closure according to claim 1 in which portions of the hinge web are recessed into the side wall and top of the lid.

4. A child-resistant dispensing closure according to claim 1 in which there are tangentially extending recesses in the rim of the cap body and tabs on the lid which extend into such recesses when said lid is in closing position thereby limiting the lateral movement of said lid relative to said cap body.

5. A child-resistant dispensing closure according to claim 4 in which the child-resistant catch means consist of a pair of diametrically opposed over-hanging lips on the rim of the cap body and lineal lips on the corresponding edges of the side wall of the lid which are adapted to remain engaged during the lateral movement of said lid relative to said cap body.

6. A child-resistant package for liquid materials, said package comprising, in combination, (a) a container having a threaded neck and a series of one-way ratchet teeth on said neck, (b) a closure for said container, said closure consisting of
  (1) a body comprising
    (a) an annular skirt having mating threads and co-operating ratchet teeth on its inner surface,
    (b) a dispensing nozzle,
    (c) flexible annular webs integrally connecting said nozzle to said skirt and closing said container neck except for said nozzle,
  (2) a saucer-shaped lid having
    (a) a flat top,
    (b) a nozzle cap on the under side of said top which is adapted to telescope over the end of said nozzle when said lid is in closing position overlying said nozzle, (3) a double-acting, flexible hinge web connected to said lid and to said body at adjacent edges thereof, said hinge web having a length sufficient for providing translatory movement of said lid relative to said body a distance sufficient for the edge of said lid to over-hang the edge of said body and also providing for movement of said lid angularly from a position atop said body, (4) catch means on said body and said lid which are adapted to engage for preventing such angular movement when said lid is in closing position, whereby said lid, first, must be moved laterally for protruding the edge of said lid beyond the edge of said body and, second, swung angularly on said hinge web for removing said nozzle cap from said nozzle.

* * * * *